United States Patent [19]

Taylor et al.

[11] 4,429,487

[45] Feb. 7, 1984

[54] BALL WHIRLING TOY AND METHOD OF EXERCISE USING SAID TOY

[75] Inventors: Ottilia Z. Taylor, San Carlos; Janos J. Lazar, Redwood City, both of Calif.

[73] Assignee: Injection Mold Partners, Ltd., San Rafael, Calif.

[21] Appl. No.: 285,005

[22] Filed: Jul. 20, 1981

Related U.S. Application Data

[63] Continuation-in-part of Ser. No. 175,077, Aug. 4, 1980, abandoned.

[51] Int. Cl.[3] ..... A63H 33/00

[52] U.S. Cl. ..... 46/43

[58] Field of Search ..... 46/43, 47, 51; 273/108, 273/DIG. 19, 109, 112, 46

[56] References Cited

U.S. PATENT DOCUMENTS

| | | | |
|---|---|---|---|
| D. 231,244 | 4/1974 | Molenaar | D21/15 K |
| 956,244 | 4/1910 | Westerberg | 273/109 |
| 3,060,627 | 10/1962 | Seketny | 46/43 |
| 3,098,316 | 7/1963 | McCarthy | 46/43 |
| 3,132,441 | 5/1964 | Mahovsky | 46/43 |
| 3,202,426 | 8/1965 | Carper . | |
| 3,638,350 | 2/1972 | Wiggen | 46/47 |
| 4,042,244 | 8/1977 | Kakovitch | 273/109 |
| 4,052,067 | 10/1977 | Carmo | 273/109 |
| 4,215,510 | 8/1980 | Worrell | 46/47 |

FOREIGN PATENT DOCUMENTS

| | | | |
|---|---|---|---|
| 2436346 | 2/1976 | Fed. Rep. of Germany | 273/DIG. 19 |
| 598488 | 2/1948 | United Kingdom | 46/43 |

*Primary Examiner*—Mickey Yu

*Attorney, Agent, or Firm*—Flehr, Hohbach, Test, Albritton & Herbert

[57] ABSTRACT

A ball whirling toy having an orbital track with a concave/convex cross-section, the concave side of which faces inwardly toward the center of the track circumscribing the orbital track. A handling arrangement is secured to or part of the orbital track whereby, upon insertion of a ball within the track, and movement of track by the handling arrangement, the ball will be caused to move around the inside of the track. "Track" means any continuous path which can withstand centrifugal force caused by a motion of a ball around this path.

7 Claims, 20 Drawing Figures

BALL WHIRLING TOY AND METHOD OF EXERCISE USING SAID TOY

This application is a continuation-in-part application of U.S. patent application Ser. No. 175,077, filed Aug. 4, 1980 (now abandoned).

This invention relates generally to games or toys having a ball associated therewith, and, more particularly to a ball whirling toy in which a ball is maintained in an orbital track by cyclical motion, upon movement of the track by means of handles or any other supporting means capable of transferring the motion to the ball.

Many games or toys presently utilize centrifugal motion to maintain a ball or other object in a position outwardly from the center of a rotating portion of the game or toy. However, no game or toy known to the applicants to be useful both as a game and for exercise utilizes centrifugal force to keep a ball rotating within a track of the specifically described type provided by applicants when the track is moved in a particular way. As will be seen hereafter, applicant's present invention comprises a ball whirling toy in which the specifically designed orbital track containing a ball is rotated or moved with a coordinated, careful motion to commence rotation of the ball around the track and in which enough movement of the orbital track is maintained to enable the centrifugal force of the moving ball to retain the ball within the track.

A ball whirling toy comprising a track having a convex-concave cross-section with the convex side facing inwardly of the orbital track. A handle means is secured to or part of the track whereby, when the handle means is grasped by or attached to a user and a ball is inserted in the track, the handle means may be moved to thereby cause the ball to move around the track.

It is therefore an important object of the invention to provide a game which may be used for entertainment.

It is a further object of the present invention to provide a game having an orbital track within which a ball may be circumferentially moved, which encourages the user to devlop coordinated movement of the hands, limbs, and body.

Another object of the present invention is to provide a game in which, through movement controlled by a user gripping the frame, a ball within a track is moved in an orbital path.

It is still a further object of the invention to provide a game having an orbital track with a single handle fixed to one side, whereby a user may grasp the handle in one hand to cause rotation of a ball contained within the track.

It is still another object of the present invention to provide a game having an orbital track with a plurality of handles which may be grasped by one or more users to enable the users to play a game wherein a ball is maintained within the track and caused to move around the circumference thereof.

And it is yet a further object of the present invention to provide a game having an orbital track with externally located flexible handles attached to a centrally located belt which is in turn attached to the waist or limb of the user, by which the user exercises by exerting enough cyclic motion to the track to maintain the ball within the track.

And, it is yet a further object of the present invention to provide a game wherein a ball is maintained in an orbital track by centrifugal force while the track is moved in any number of different directions, and which motion of the track must be maintained at a sufficient speed to prevent the ball from leaving the track.

Still another object of the present invention is to provide a ball whirling toy of the general type recited and specifically one having a particularly designed orbital track configuration requiring skilled handling of the track to retain the ball therein during movement of the ball therein.

Yet another object of the present invention is to provide a track configuration which is especially suitable for varying the orientation of the toy during rotation of the ball around the track, for varying the difficulty of play.

Other objects and features of the present invention will become apparent hereinafter As will be seen hereinafter, the ball whirling toy disclosed herein is one which includes means defining a circumferential track having an inwardly directed concave surface. In accordance with a preferred embodiment of the present invention, this surface includes a plurality of distinct side-by-side circumferential surface segments, each of which has a substantially straight cross-section extending at an obtuse angle with an adjacent surface segment. A ball sized to fit on the track in tangential relationship with any one of the surface segments also forms part of the toy along with handle means connected with the track defining means. In this way, the device disclosed herein may be employed as a toy (as its name implies) or as a means of exercise merely by placing the ball on the track and moving the handle means in predetermined ways so as to cause the ball to move around the track on any one of the surface segments depending on the particular movement of the handle means and orientation of the track.

The ball whirling toy disclosed herein will be described in more detail hereinafter in a number of different embodiments and in conjunction with the drawungs wherein.

Figure 5:
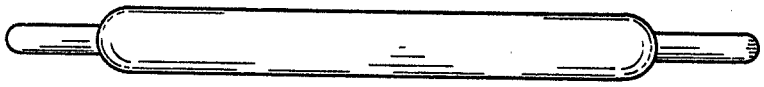
FIG. 5 is a top plan view of the toy of the present invention looking down on the handle or holding means thereof.

The present invention is a ball whirling toy, or exercise device in which a ball running within the inside surface of an orbital track is maintained in position by the centrifugal force of the moving ball. The game includes handling means which are used to move the track in such a pattern of motion as to provide sufficient rate of speed to the ball to maintain it on the inside surface of the track.

Turning now to the drawings, there is shown in FIG. 1 through FIG. 4 one preferred embodiment of the present invention comprising a ball whirling toy having a substantially circular track 12. The track may taken any convenient shape, preferably substantially semi-circular in cross-section. In addition, the circular track may be made from any desired material such as light, transparent plastic.

The concave side of the semi-circular or other cross-section of the track is shown facing inwardly toward the central axis of a circle circumscribing the track. In this manner, the outer periphery or external surface of the track faces outwardly from the central axis. The track is provided with a pair of handles 13 secured to the outer periphery of the track. They are substantially identical in configuration and axially-aligned with each other and with a line passing through the center of the circular track. The handles are preferably made from the same plastic material as that of the track and may be secured to the outside surface of the track in any desired manner, such as by fusion, gluing, or maybe integrally therewith.

In order to play a game or exercise with this toy, a ball 14 of any desired material, such as hard rubber, and of any convenient size which will fit into the width of the semi-circular track to rest on the inside surface thereof, is used. The ball is placed within the track and causes to roll or move along the inside surface thereof by movement of the track through means of a pair of handles. One person may grasp both of the handles, or two separate persons may each hold one of the handles.

To commence the game or exercise, the ring is preferably placed in a perpendicular position with the handles in either a horizontal or vertical plane, and the ball resting on the lowest inside surface of the track.

Movement is then imparted from the hand or hands of the user or users to the ball whirling toy with the track remaining in the same starting position. The ball will then be caused to be rocked along the inside surface of the track until the movement of the ball is sufficient to permit it to travel around the whole length of the inner surface of the track without falling out due to gravity. If the cyclic movement of the hands of the person or persons holding the track is strong and skilled enough, the ball will continue to run along the inside surface of the track as long as rhythmical, cyclic motion is applied thereto.

After the ball has been started along the track and is moving at a desired rate, the ball whirling toy then may be moved out of the perpendicular starting position. In this manner, the ball may be continuously moved around the track with the toy held in any position desired by a user or users. The continuous circular movement in any position enables the user to go through a series of healthy, rhythmical movements or exercise. Concurrently, the requirements of continued repetition of motion teaches coordination to the user.

The centrifugal force of the ball moving or running along the inside surface of the track of the ball whirling toy will maintain the ball in position, and prevent the ball from dropping out of the track, as long as the movement imparted by the user to the track is sufficiently vigorous.

A further embodiment of the invention is shown in FIGS. 7–12 of the drawings. This embodiment comprises a toy having a circular track 12 which may be identical in configuration and size with the track 12 of the ball whirling toy. However, if desired, this ring may be made of a different size, or diameter, as long as the cross-section thereof remains substantially a shape which enables the ball 14 to be inserted therein.

The second embodiment of applicants' invention is provided with a single handle means composed of a holding member 15 aligned with the central axis of the substantially circular track and supported from or connected to the track 12 by identical arms or supporting rods 16, four of which are shown. Any number of supporting arms may be used, depending on the stiffness of the material used to construct the track 12 and the rods 16. As shown, the track 12 and supporting arms 16 are preferably constructed from the same lightweight, transparent plastic used to construct the ball whirling toy. The arms 16 are connected or secured to one side of the exterior surface of the track in any convenient manner, such as by fusing or gluing, and or may be integrally therewith, if the entire element is extruded.

Only one person is able to use the ring game of FIGS. 7–12 due to the formation of the holding means. The holding member 16 is preferably held in only one hand of a user. However, a person with small hands, such as a child, may take a holding member in both hands. The ball 14 is placed in the track 12 and moved along the inside surface thereof, in the manner described above. That is, by holding the track in a vertical position, moving the handle 15 and track 12 in a cyclical direction. After the ball has commenced to move within the track, this ring may also be taken out of the vertical starting position and actuated or circularly moved in any desired position.

Figure 19:
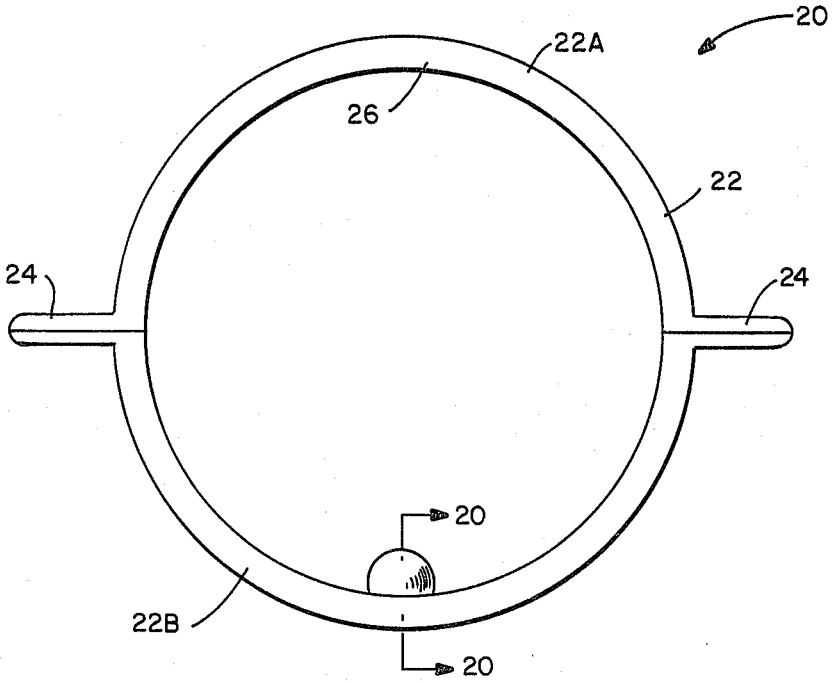
FIG. 19 is a front elevational view of still another ball whirling toy of the present invention, specifically one having a preferred cross-section.
Figure 20:
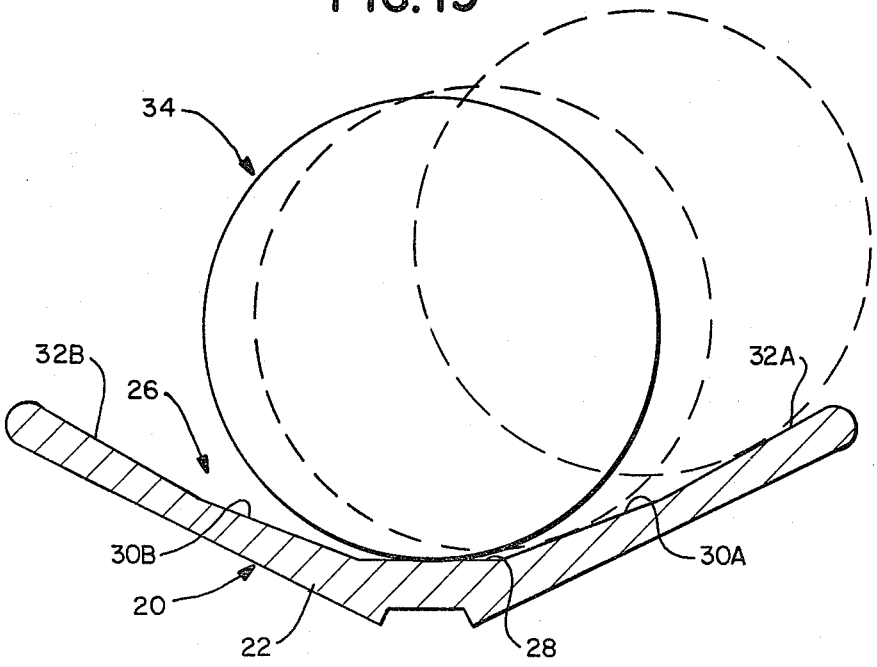
FIG. 20 is a cross-sectional view of the toy of FIG. 19 taken generally along line 20—20 of FIG. 19.

Referring now to FIGS. 19 and 20, attention is directed to a ball whirling toy 20 which has been designed in accordance with a preferred embodiment of the present invention. With the exception of its cross-sectional configuration, toy 20 may be identical to the embodiment illustrated in FIGS. 1–3. Thus, toy 20 includes a circumferential, preferably annular main body 22, constructed of lightweight plastic or like material, and a pair of aligned handles 24 projecting out from main body 22 in a common plane with the latter. Main body 22 defines a radially inwardly facing circumferential (preferably annular) track 26 which is designed in accordance with the present invention and which is best shown in FIG. 20. As seen there, the track is actually an inwardly facing concave surface including a plurality of distinct side-by-side circumferntial (preferably annular) surface segments 28, 30A and 30B and 32A and 32B, each of which has a substantially straight cross-section. The surface segment 28 is centrally located on track 26 and extends laterally in a direction parallel with the axis of main body 22. Each of the surface segments 30A, 30B extends radially inward from and at an obtuse angle with one side of central surface segment 28, as seen in FIG. 20. The surface segment 32A extends radially inwardly from and at an obtuse angle with the otherwise free side of surface segment 30A and the surface segment 32B extends radially inwardly from and at an obtuse angle with the otherwise free side of surface segment 30B. In a preferred embodiment, for a given width of central segment 28, the width of each of the intermediate segments 30A, 30B is between about 110% and 120% of the width of the central segment and the width of the outer segments 32A, 32B is between about 160% and 180% of the width of the central segment. In an actual working embodiment of toy 20, although this embodiment is not shown to scale in FIGS. 19 and 20, the overall diameter of main body 20 (its maximum inner diameter) is approximately 19 inches. Central surface segment 28 is 0.40 inch wide, each of the surface segments 30A, 30B is 0.46 inch wide and each of the surface segments 32A, 32B is 0.68 inch wide. In this same embodiment, the angle between the central surface 28 and each of the intermediate surface segments 30A, 30B is 155°, and the angle between each intermediate surface segment 30A, 30B and its adjacent outer surface segment 32A, 32B, respectively, is 171°.

Figure 2:
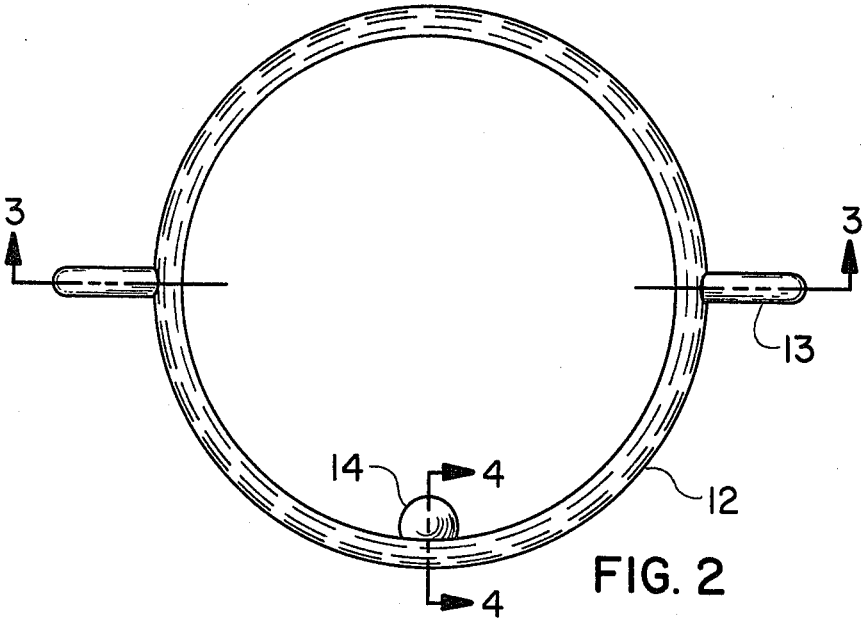
FIG. 2 is a front elevational view of the toy of FIG. 1.
Figure 3:
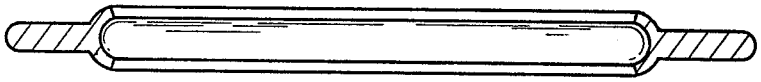
FIG. 3 is a cross-sectional view taken along line 3—3; of FIG. 2.
Figure 1:
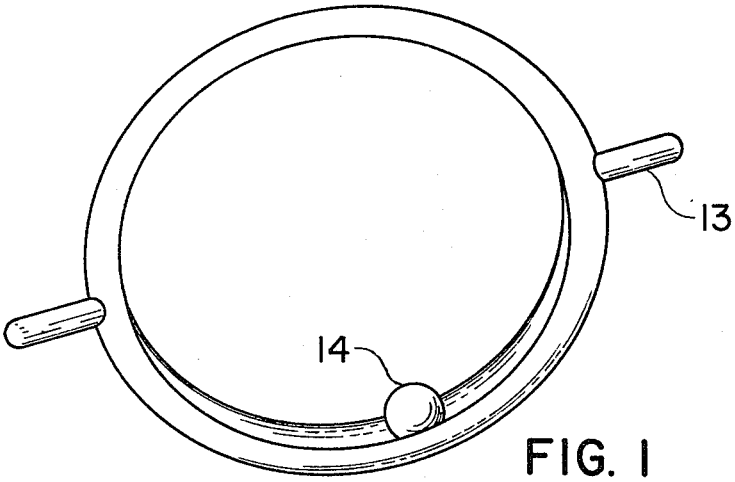
FIG. 1 is a perspective view of one embodiment of a ball whirling toy of the present invention.
Figure 8:
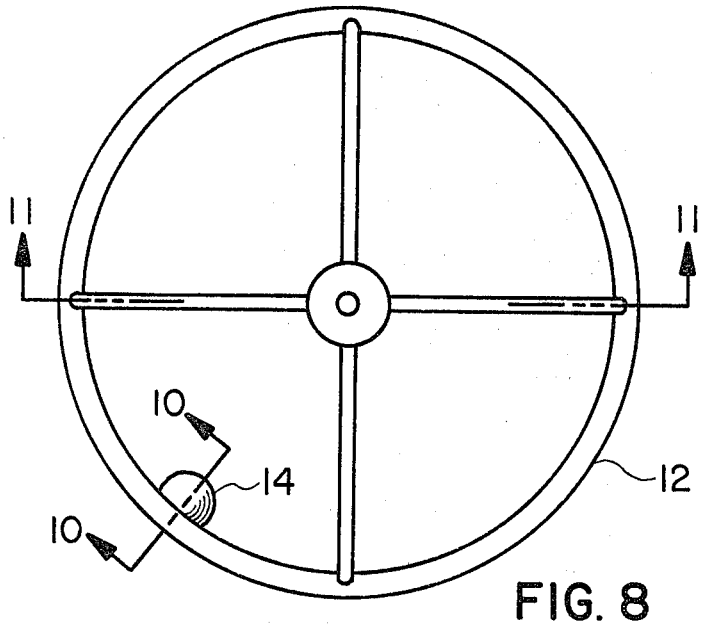
FIG. 8 is a top elevational view of the ball whirling toy of FIG. 7.
Figure 12:
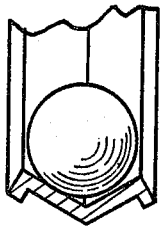
FIG. 12 is an alternate cross-sectional view taken along line 10—10.
Figure 10:
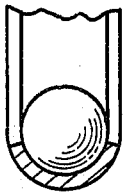
FIG. 10 is a cross-sectional view taken along line 10—10 of FIG. 8.
Figure 9:
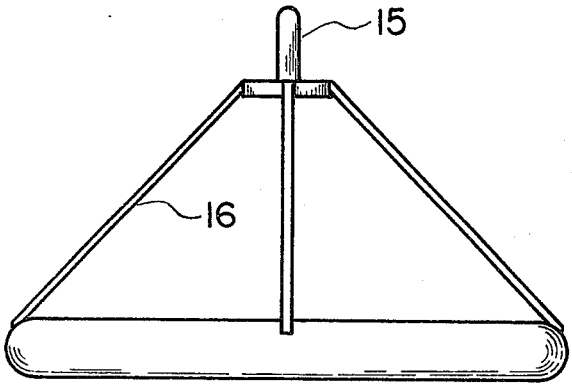
FIG. 9 is a side elevational view of the ball whirling toy of FIG. 7.
Figure 11:
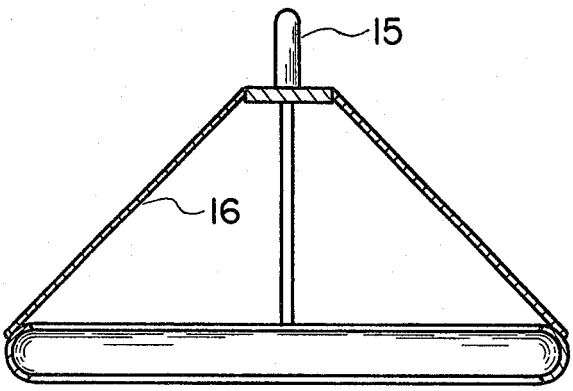
FIG. 11 is a cross-sectional view taken along line 11—11 of FIG. 8.
Figure 7:
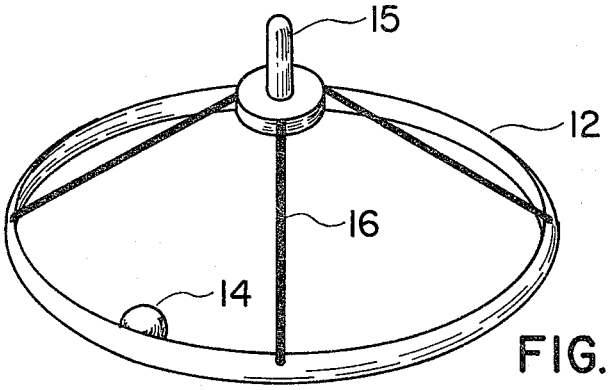
FIG. 7 is a perspective view of a second embodiment of the toy of the present invention.

The ball whirling toy 20 thus far describes both generally and specifically, utilizes a ball 34 in the same manner as the embodiment previously described with respect to FIGS. 1–3. In the case of toy 20, ball 34 is preferably sized to fit on track 26 in tangential relationship with any one of the surface segments 28, 30A, 30B or 32A, 32B. In the actual embodiment recited above, the ball has a diameter of 3.75 inches. However, it is preferred to have the ball smaller, e.g., about 2.5 inches, to provide more lateral freedom (to be discussed below) with regard to the surface segments of the actual embodiments discussed above. Once the ball is placed on the track, the handles can be moved in predetermined ways to cause it to move around the track, as described previously. In the specific embodiment illustrated in FIGS. 19 and 20, the ball can be made to move around on a specific one of the surface segments forming the track, depending upon the particular way in which the handles are moved and the orientation of the track itself. More specifically, if the main body 22 is maintained in a vertical plane as the handles are moved, ball 34 will tend to ride on center surface segment 28 of track 26. If, on the other hand, the track is oriented in a horizontal plane and the handles are moved in the appropriate manner (with sufficient force), the ball 34 can be made to ride on either of the outer tracks 32A, 32B. If the track is disposed at an angle between these extreme positions, that is, between its vertically extending position and its horizontally extending position, ball 34 can be made to ride on either of the intermediate tracks 30A, 30B. Obviously, by appropriately positioning track 26 and properly manipulating handles 24, the ball 34 can be made to ride along any lateral point on track 26 and can even be made to change its lateral position on the track as it moves around the latter. In this regard, it should be noted that the track itself is sufficiently wider than it is deep, and is sized relative to the diameter of ball 34 so as to allow the ball to freely move laterally across the track. Moreover, there is nothing in the track's cross-sectional configuration which prevents the ball from moving laterally off the track.

Figure 4:
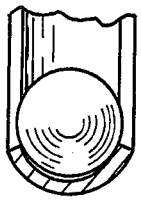
FIG. 4 is a cross-sectional view taken along line 4—4 of FIG. 2.
Figure 6:
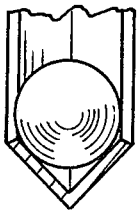
FIG. 6 is an alterate cross-sectional view of FIG. 2, that is taken along line 4—4 of FIG. 2.

Ball whirling toy 20 has a number of advantages over and above the embodiment illustrated in FIGS. 1–3 (with either the FIG. 4 or FIG. 6 cross-section). First, ball whirling toy 20 is more difficult to play because the ball 34 is not laterally locked into place by its associated track. This is to be contrasted with the track configurations illustrated in FIGS. 4 and 6 which preclude movement of the ball laterally. By freeing up the ball for lateral movement, the individual playing with the toy must be constantly attentive to what he is doing, and he must carefully control movement of the track. This, in turn, requires more exercise by the player than is necessary when playing with the embodiment illustrated in FIGS. 1–3. Moreover, because of the cross-sectional configuration of toy 20, the individual player is provided with a greater variety since he can manipulate the toy in a number of different ways to cause the ball to move not only in a circular fashion on any of a number of surface segments, but also in accordance with a desired lateral pattern.

Figure 13:
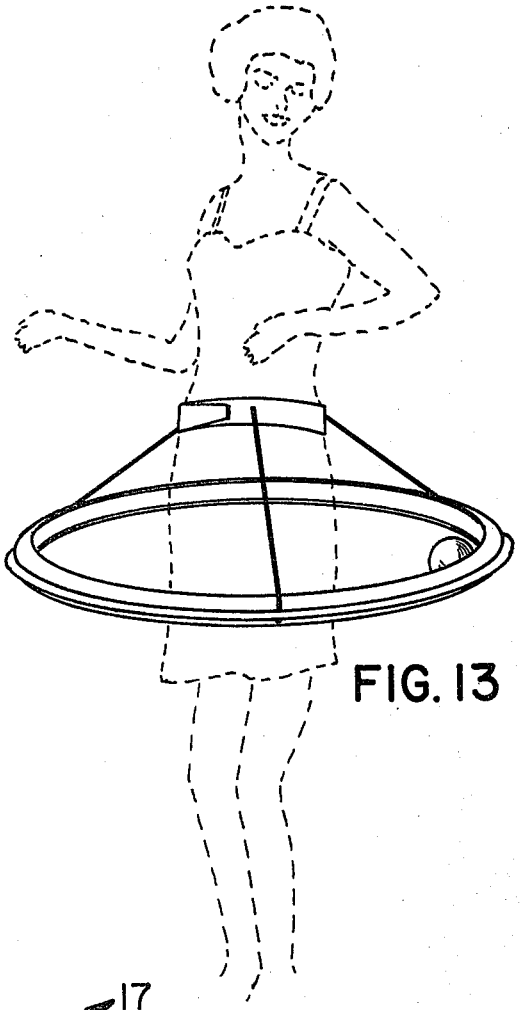
FIG. 13 is a perspective view of the third embodiment of the toy of the present invention showing the track and the supporting means of the track on the user's limb, hip or waist.
Figure 17:
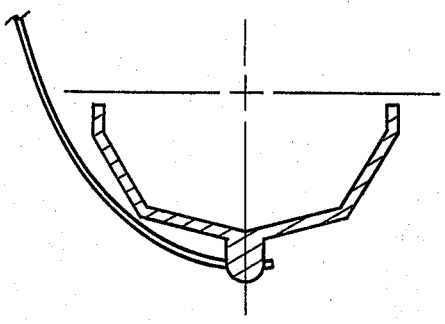
FIG. 17 is a cross-sectional view of FIG. 14 taken along line 18—18.
Figure 18:
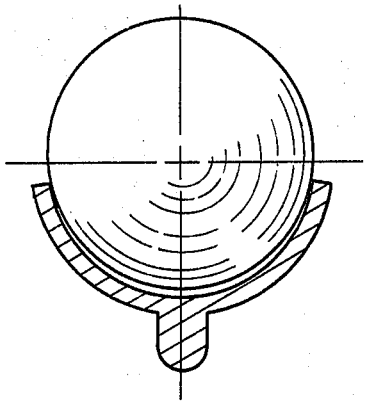
FIG. 18 is an alternate cross-sectional view of FIG. 14 taken along line 19—19.
Figure 14:
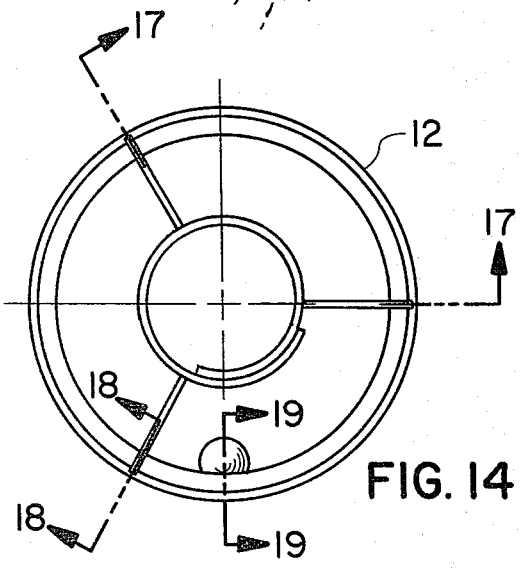
FIG. 14 is a top view of the harnessed ball whirling toy.
Figure 15:
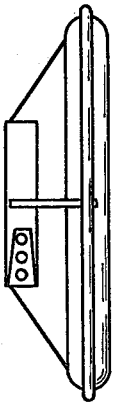
FIG. 15 is the side view of FIG. 14.
Figure 16:
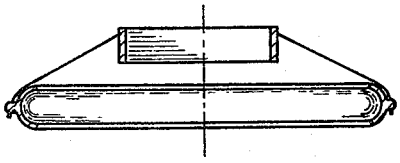
FIG. 16 is a section taken along line 17—17 of FIG. 14.

While overall ball whirling toy 20 has been shown having a track consisting of the surfaces 28, 30A, 30B, and 32A, 32B, it is to be understood that the present invention is not limited to this particular configuration, although it forms part of the preferred embodiment. Moreover, it is to be understood that the toy illustrated in FIGS. 1–3 as well as the embodiments illustrated in FIGS. 7 and 13 can be made with the cross-sectional configuration illustrated in FIG. 20. In addition, main body 22 illustrated in FIG. 19 and the main body forming part of the embodiment illustrated in FIGS. 1–3 are preferably made by putting together two integrally formed (preferably integrally molded) body sections *22a* and *22b*. As illustrated in FIG. 19, each of these body sections is integrally formed with one-half of each handle 24. In this way, the two body sections can be connected together by suitable bonding means at the handle sections.

What is claimed is:

1. A ball whirling toy comprising: means defining an annular track having a radially inwardly facing concave surface, said surface consisting of a plurality of distinct, directly adjacent side-by-side annular surface segments greater in number than two, each of which has a substantially straight cross-section extending at an obtuse angle with any directly adjacent surface segment such that the overall cross-section of the radially inwardly facing concave surface is substantially wider than it is deep; a ball sized to fit on said track in tangential relationship with any one of said surface segments, said surface segments consisting of a central segment extending in a direction parallel with the axis of said track, a pair of intermediate surface segments on opposite sides of and directly next to said central segment and a pair of outer surface segments on the otherwise free sides of and directly next to said intermediate segments; and handle means connected with said track defining means, whereby said ball may be placed on said track and said handle means moved in predetermined ways to cause said ball to move around said track on any one of said surface segments or from said one segment to a next adjacent segment depending upon the particular movement of said handle means and the orientation of said track and whereby said ball is capable of moving across all of said segments and off of the track unless this is prevented by the appropriate manipulation of said handle means.

2. A ball whirling toy comprising: means defining a circumferential track having an inwardly facing concave surface, said surface including a plurality of distinct, directly adjacent side-by-side circumferential surface segments, each of which has a substantially straight cross-section extending at an obtuse angle with any directly adjacent surface segment, said surface segments including a central segment extending in a direction parallel with the axis of said track, a pair of intermediate surface segments on opposite sides of and directly next to said central segment and a pair of outer surface segments on the otherwise free sides of and directly next to said intermediate segments; and a ball sized to fit on said track in tangential relationship with any one of said surface segments, whereby said ball may be placed on said track and said track moved in predetermined ways to cause said ball to move around said track on any one of said surface segments or from said one segment to a next adjacent segment depending on the particular movement and orientation of said track.

3. A method of exercising comprising the steps of: providing an exercise device in the form of a ball whirling toy including means defining a circumferential track having an inwardly facing concave surface, said surface having a plurality of distinct, directly adjacent side-by-side circumferential surface segments, each of which has a substantially straight cross-section extending at an obtuse angle with any directly adjacent surface segment, said surface segments including a central segment extending in a direction parallel with the axis of said track, a pair of intermediate surface segments on opposite sides of and directly next to said central segment and a pair of outer surface segments on the otherwise free sides of and directly next to said intermediate segments; a ball sized to fit on said track in tengential relationship with any one of said surface segments, and handle means connected with said track defining means, whereby said ball may be placed on said track and said handle means moved in predetermined ways to cause said ball to move around said track on any one of said surface segments or from said one surface segment to an adjacent segment depending upon the particular movement of the handle means and the orientation of said track defining means; placing said ball on said track; and continuously moving said handle means and said track defining means in a way which causes said ball to move around said track on any given one of said surface segments or from one segment to the next one.

4. A ball whirling toy comprising: means defining a circumferential track having an inwardly facing concave surface, said surface including a plurality of distinct, directly adjacent side-by-side circumferential surface segments, each of which has a substantially straight cross-section extending at an obtuse angle with any directly adjacent surface segment, said surface segments including a central segment extending in a direction parallel with the axis of said track, a pair of intermediate surface segments on opposite sides of and directly next to said central segment and a pair of outer surface segments on the otherwise free sides of and directly next to said intermediate segments; a ball sized to fit on said track in tangential relationship with any one of said surface segments; and handle means connected with said track defining means, whereby said ball may be placed on said track and said handle means moved in predetermined ways to cause said ball to move around said track on any one of said surface segments or from said one segment to a next adjacent segment depending on the particular movement of said handle means and orientation of said track.

5. The ball whirling toy of claim 4 wherein said concave surface consists of said segments.

6. The ball whirling toy of claim 5 wherein said track is annular, wherein for any given width of said central surface segment, the width of each of said intermediate segments is between about 110% of the width of said central segment and the width of each of said outer segments is between about 160% and 180% of the width of said central segment and wherein the angle between said center segment and each intermediate segment is about 155° and wherein the angle between each intermediate segment and adjacent outer segment is about 171°.

7. The ball whirling toy of claim 4 wherein the cross-section of said concave surface is substantially wider than it is deep and wherein said ball is sized relative to said surface so as to be able to roll across the latter in a transverse direction.

* * * * *